US010948156B2

(12) United States Patent
Thijssen et al.

(10) Patent No.: US 10,948,156 B2
(45) Date of Patent: Mar. 16, 2021

(54) COVER FOR LED LUMINAIRES

(71) Applicant: SIGNIFY HOLDING B.V., Eindhoven (NL)

(72) Inventors: Johannes Maria Thijssen, Best (NL); Silva Maria Booij, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/461,314

(22) PCT Filed: Nov. 16, 2017

(86) PCT No.: PCT/EP2017/079471

§ 371 (c)(1),
(2) Date: May 15, 2019

(87) PCT Pub. No.: WO2018/095805

PCT Pub. Date: May 31, 2018

(65) Prior Publication Data

US 2020/0072437 A1 Mar. 5, 2020

(30) Foreign Application Priority Data

Nov. 22, 2016 (EP) ..... 16200018

(51) Int. Cl.
*F21V 3/02* (2006.01)
*F21K 9/27* (2016.01)
(Continued)

(52) U.S. Cl.
CPC ..... *F21V 3/02* (2013.01); *F21K 9/27* (2016.08); *F21Y 2103/10* (2016.08); *F21Y 2115/10* (2016.08)

(58) Field of Classification Search
None
See application file for complete search history.

(56) References Cited

U.S. PATENT DOCUMENTS 4,609,978 A 9/1986 Hsieh et al.
2003/0063473 A1* 4/2003 Aynie ..... B60Q 1/0052 362/509

(Continued)

FOREIGN PATENT DOCUMENTS

CN 101684930 B 3/2010
CN 201661991 U 12/2010

(Continued)

*Primary Examiner* — Vip Patel
(74) *Attorney, Agent, or Firm* — Daniel J. Piotrowski

(57) ABSTRACT

A luminaire housing (10) comprises a light chamber (15) at least partially delimited by a light-transmissive cover (30). The light chamber comprises a mounting region for mounting at least one solid state lighting element. The cover comprises at least one rounded corner section (31) in between two further sections (33), wherein the rounded corner section has an inner surface (311) having opposing inner endpoints (103, 105) and an outer surface (313) having opposing outer endpoints (113, 115). Each inner endpoint is positioned relative to the outer endpoint proximal to said inner endpoint such that no ray of light (301, 301') emitted by the at least one solid state lighting element entering the light-transmissive cover via an inner surface (331) of a further section exits the light-transmissive cover from the outer surface of a curved corner section. A luminaire including such a luminaire housing, a design method and a manufacturing method for such a luminaire housing are also disclosed.

9 Claims, 10 Drawing Sheets

(51) Int. Cl.
*F21Y 103/10* (2016.01)
*F21Y 115/10* (2016.01)

(56) References Cited

U.S. PATENT DOCUMENTS

| | | | |
|---|---|---|---|
| 2010/0073927 | A1 | 3/2010 | Lewin et al. |
| 2015/0003069 | A1 | 1/2015 | Medendorp, Jr. et al. |
| 2015/0345715 | A1 | 12/2015 | Castillo et al. |
| 2016/0258609 | A1 | 9/2016 | Fujimoto et al. |

FOREIGN PATENT DOCUMENTS

| | | | |
|---|---|---|---|
| CN | 201944775 | U | 8/2011 |
| CN | 102472470 | A | 5/2012 |
| CN | 203421614 | U | 2/2013 |
| CN | 103348182 | A | 10/2013 |
| CN | 104214660 | A | 12/2014 |
| CN | 104421712 | A | 3/2015 |
| CN | 105202384 | A | 12/2015 |
| DE | 202008014905 | U1 | 8/2009 |
| EP | 2693116 | A1 | 2/2014 |
| EP | 3030833 | A1 | 6/2016 |
| JP | 2011028946 | A | 2/2011 |
| WO | 2012011528 | A1 | 1/2012 |
| WO | 2012081360 | A1 | 6/2012 |
| WO | 2015129671 | A1 | 9/2015 |

* cited by examiner

COVER FOR LED LUMINAIRES

CROSS-REFERENCE TO PRIOR APPLICATIONS

This application is the U.S. National Phase application under 35 U.S.C. § 371 of International Application No. PCT/EP2017/079471, filed on Nov. 16, 2017 which claims the benefit of European Patent Application No. 16200018.6, filed on Nov. 22, 2016. These applications are hereby incorporated by reference herein.

FIELD OF THE INVENTION

The present invention relates to a luminaire housing comprising a light chamber delimited by a light-transmissive cover comprising at least one rounded corner section in between two further sections.

The present invention further relates to a luminaire comprising such a luminaire housing.

The present invention further relates to a method of designing such a luminaire housing.

The present invention further relates to a method of manufacturing such a luminaire housing.

BACKGROUND OF THE INVENTION

Solid state lighting (SSL), e.g. LED lighting, is becoming increasingly popular due to its much lower energy consumption and much improved lifetime compared to previous generation lighting, e.g. incandescent or fluorescent lighting. Nowadays, new luminaires are being designed with SSL elements in mind, such that the optical performance of the luminaire is tailored to the SSL elements.

However, in many cases, luminaires designed for previous generation lighting are being reused with SSL elements, for example by replacing the previous generation lighting. Consequently, the luminaire may no longer exhibit the desired optical performance due to the fact that SSL elements have a distinctly different optical characteristic compared to previous generation light sources such as (tubular) incandescent or fluorescent lighting.

For example, waterproof luminaires such as the Philips Pacific Performer WT360C typically comprise a transparent waterproof housing including a cover, which may be removable in order to provide access to the interior of the luminaire, e.g. to replace the light source therein. Such a cover typically comprises rounded corner sections for aesthetic, mechanical and/or optical reasons as well as for health and safety reasons, e.g. to prevent injury by sharp corners. Such a prior art luminaire is schematically depicted in FIG. 1, in which the elongate luminaire comprises a luminaire housing 10 including a base 20 and light-transmissive polycarbonate cover 30 having rounded corner sections 31 and linear (planar) sections 33. The cover 20 delimits an optical chamber 15 in which one or more fluorescent light tubes 25, e.g. T5 tubes, are mounted in a mounting region within the optical chamber 15, e.g. in fitting brackets or the like. Upon placement of one or more rows 21 of SSL elements 23 within such a housing 10, as schematically depicted in FIG. 2, e.g. within a transparent tubular body mimicking a fluorescent tube, optical artefacts in its luminous output can be clearly detected, in particular when the SSL elements are small relative to the diameter of the tubular body. Such optical artefacts include non-uniformity in the luminous distribution over the cross-section of the luminaire both in terms of colour and intensity, e.g. dark and bright lines as well as colour effects that become visible on the surfaces onto which the luminous distribution of such a luminaire is projected. Further optical artefacts may be caused by extrusion stripes in the extruded polycarbonate cover 30.

CN203421614U discloses an LED lamp shade that is hollow and is in a shape of a long square column. The inner wall of the bottom of the lamp shade is a curved surface, the inner wall surfaces of a first side edge and a second side edge which are opposite to each other of the inner wall of the side edge of the lamp shade are irregular saw-toothed refraction structures. The angles of saw teeth of the inner wall surfaces of the first side edge are increased gradually from the top of the inner side to the bottom of the inner side, and the angles of the saw teeth of the inner wall surfaces of the second side edge are increased gradually from the top of the inner side to the bottom of the inner side in order to achieve an even luminous distribution. However, it has been found that at least some of the aforementioned optical artefacts still exist for this lamp shade.

SUMMARY OF THE INVENTION

The present invention seeks to provide a luminaire housing comprising a light chamber delimited by a light-transmissive cover comprising at least one rounded corner section in between two further linear, planar sections for which such optical artefacts have been reduced.

The present invention further seeks to provide a luminaire comprising such a luminaire housing.

The present invention further seeks to provide a method of designing such a luminaire housing.

The present invention further seeks to provide a method of manufacturing such a luminaire housing.

According to an aspect, there is provided a luminaire housing comprising a light chamber at least partially delimited by a light-transmissive wall with a thickness Tw of a cover comprising at least one rounded corner section in between two further, linear, planar sections, said light chamber comprising a mounting region for mounting at least one solid state lighting element, wherein the rounded corner section has an inner surface having opposing inner endpoints and an outer surface having opposing outer endpoints, wherein a plane under critical angle θc at the inner surface at an inner endpoint does not extend through the outer surface of the rounded corner section, such that no ray of light emitted by the at least one solid state lighting element entering the light-transmissive cover via the further inner surface of the further section exits the light-transmissive cover from the outer surface of the rounded corner section. For example, each inner endpoint is positioned relative to the outer endpoint proximal to said inner endpoint such that a ray of light emitted from the mounting region passing through the inner endpoint also passes through the proximal outer endpoint.

The critical angle in this respect is the angle at which total internal reflection of a light ray inside the cover would occur, for example for PolyMethylMethAcrylate (PMMA) with an index of refraction of about n=1.50 the critical angle θc=41.8°, or PolyCarbonate (PC) with an index of refraction of n=1.60 the critical angle is, or glass with an index of refraction n=1.46. Below a list of refractive index n2 of the cover material versus critical angle from air with reactive index n1=is given:

| n1 air | n2 cover | n1/n2 | crit angle |
|---|---|---|---|
| 1 | 1.3 | 0.769231 | 50.31037 |
| 1 | 1.5 | 0.666667 | 41.83152 |
| 1 | 1.7 | 0.588235 | 36.05015 |
| 1 | 2 | 0.5 | 30.01522 |
| 1 | 2.2 | 0.454545 | 27.0494 |

Even light rays of light from the light source impinging onto the cover inner wall at a further section at an angle of about 90° would not exit the cover the cover through the outer surface of the rounded corner section. In dependence of the thickness Tw of the wall, the outer endpoint then is shifted over the wall towards the centre of the rounded corner relative to the inner endpoint proximal to said outer end point at least by a distance Ds=tan(θc)*Tw. Application of this condition for the rounded corner sections of the cover, allows the mounting region for mounting of the light source to comprise the whole light chamber. When the angle of incidence θi of a light ray on the inner surface at the inner endpoint is 90°, then said ray propagates through the outer wall of the further section and tangent to the outer endpoint proximal to said inner endpoint.

The present inventors have realized that a deterioration in the optical performance of a luminaire comprising rounded corner sections upon replacement of its original light source with SSL equivalents is caused by the reduction in form factor associated with such replacement. In particular, whereas the rounded corner section may be considered small relative to the overall size of the original light source, e.g. a (tubular) light bulb or the like, this consideration no longer holds when replacing the original light source with SSL elements, e.g. LEDs, which may be approximated as point light sources. This causes boundary artefacts at the boundary between the rounded corner section and the further sections, e.g. (near-)planar sections, due to light rays entering the cover through an inner surface of a further section close to a neighbouring rounded corner section exiting an outer surface of the neighbouring rounded corner section, which causes increased divergence of light rays exiting the cover. Such divergence may be reduced by ensuring that the cover is designed such that substantially all light rays entering a further section of the cover also exit from the further section. This reduction is ensured by positioning the inner and outer endpoints of such a curved corner section as recited above. Said divergence can even be further reduced when at the endpoints a tangent to the surface of the rounded corner section is parallel to a tangent to a proximal further inner surface of its proximal further section, i.e. both the inner and outer surface have a smooth transision between the further, linear, planar section and the rounded corner section, in other words said transition is without a discontinuity, such as a kink or step.

The light-transmissive cover comprises a pair of said rounded corner sections, for example as rounded corners of a cover having a U-shaped cross-sectional profile. In such a cover, one of said further sections, e.g. a (near-)planar section, may be located in between the pair of rounded corner sections.

The luminaire housing might have the feature that the mounting region is outside an area range between the wall and at least one of said planes alongside its proximal further section of said wall for reduing the risk of uncontrolled stray light. When light rays imping at acute angles on the inner surface, the chance on reflection of said rays enhances which involves the risk of undesired stray light. Hence, by setting the angle of incidence at at least the critical angle, the risk of stray light is reduced. Typically in the mounting region, means for electrical connection of the light source, such as electrical contacts or PCB-mounts, are provided.

In an embodiment, the mounting region and the rounded corner section are elongated in parallel elongation directions. For example, the luminaire housing may be an elongated housing such as a tubular housing including a cover with rounded corners.

The light-transmissive cover may in some embodiments be transparent, which has the advantage that a directional luminous output may be produced having reduced optical artefacts compared to comparable prior art covers.

According to a further aspect, a luminaire is provided that includes the luminaire housing of any of the herein described embodiments and that further includes at least one solid state lighting element mounted in the mounting region. Such a luminaire benefits from exhibiting fewer optical artefacts due to the inventive design of the luminaire housing and the light-transmissive cover in particular.

According to yet a further aspect, there is provided a computer-implemented method of designing a light-transmissive cover having a defined refractive index and comprising at least one rounded corner section in between two further sections such as (near-) planar sections for a luminaire housing further comprising a light chamber delimited by the light-transmissive cover, the method comprising receiving a defined position of a solid state light source within the light chamber; receiving a specification of the orientation, thickness and position of each of the further sections relative to the defined position; defining a first spline representing an inner surface of the rounded corner section, said first spline comprising a first inner endpoint connecting to an inner surface of the first further section of the two further sections and a second inner endpoint connecting to an inner surface of the second further section of the two further sections; defining a second spline representing an outer surface of the rounded corner section, said second spline comprising a first outer endpoint connecting to an outer surface of the first further section and a second outer endpoint connecting to an outer surface of the second further section by calculating the position of the first inner endpoint and the second outer endpoint such that a simulated first ray of the solid state light source passing through the first inner endpoint also passes through the first outer endpoint and a simulated second ray of the solid state light source passing through the second inner endpoint also passes through the second outer endpoint; and generating an output of a design specification of the light-transmissive cover including the defined first and second splines, wall thicknees Tw, and relative positions of inner end point and outer end point.

This facilitates the design of a light-transmissive cover of a luminaire housing in which optical artefacts caused by non-optimized boundary conditions between a rounded corner section and an adjacent further section are reduced, thereby improving the overall optical performance of a light-transmissive cover designed in accordance with such a method.

The outer endpoints of the outer spline may be correctly positioned by calculating a ray path through the light-transmissive cover for each ray based on an angle of incidence of said ray with said inner endpoint and the defined refractive index; and positioning the corresponding outer endpoint on said ray path. This ensures that these light rays define appropriate boundary conditions such that light rays entering a further section of the material of the light-transmissive cover cannot crossover into a curved corner section of the cover, thereby avoiding optical artefacts associated with such a crossover.

In an embodiment, the computer-implemented method further comprises receiving an adjustment of a curvature of the second spline; calculate a degree of convergence or divergence for light rays originating from the solid state light source at exiting the rounded corner section for said adjusted curvature; and accepting the curvature adjustment if said degree of convergence or divergence exhibits an improvement compared to light rays originating from the solid state light source at exiting the rounded corner section as defined by the second spline without said adjusted curvature. In this manner, once the boundary conditions between a further section, e.g. a (near-)planar section, and a curved corner section of the light-transmissive cover are appropriately designed, the optical performance of the curved corner section may be further optimized by (iteratively) adjusting the curvature of the outer surface of the curved corner section represented by the second spline.

This further may include determining a thickness across the rounded corner section including the adjustment to the curvature of the second spline; and rejecting said curvature adjustment if said thickness exceeds a design tolerance to ensure that light-transmissive cover design can still be manufactured within defined design or manufacturing tolerances.

In an embodiment, the curvature of the first spline is defined by a first vector associated with the first inner endpoint and a second vector associated with the second inner endpoint; the curvature of the second spline is defined by a first further vector associated with the first outer endpoint and a second further vector associated with the second outer endpoint; and receiving an adjustment of a curvature of the second spline comprises receiving a change in length at least one of the first further vector and second further vector. This facilitates straightforward adjustment of the curvature of the second spline (and first spline if so desired).

Preferably, each spline is tangential to the further section, e.g. a (near-)planar section, it connects to ensure desirable boundary conditions between this section and its connecting rounded corner section although small deviations from such a tangential arrangement may be tolerated.

According to still a further aspect, there is provided a method of manufacturing a light-transmissive cover for a luminaire housing, the cover having a defined refractive index and comprising at least one rounded corner section in between two further sections, the method comprising manufacturing a mold for the light-transmissive cover using the design specification, including generating an output of a design specification of the light-transmissive cover including wall-thickness Tw, and relative positions of inner end points and proximal outer end points and the defined first and second splines as produced by the aforementioned computer-implemented method and manufacturing the light-transmissive cover with said mold to provide a light-transmissive cover with improved optical performance as explained above.

The light-transmissive cover may be manufactured by extrusion or a moulding technique such as injection moulding, e.g. using a suitable polymer material such as polycarbonate, poly (methyl methacrylate) and poly ethylene terephthalate for example.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
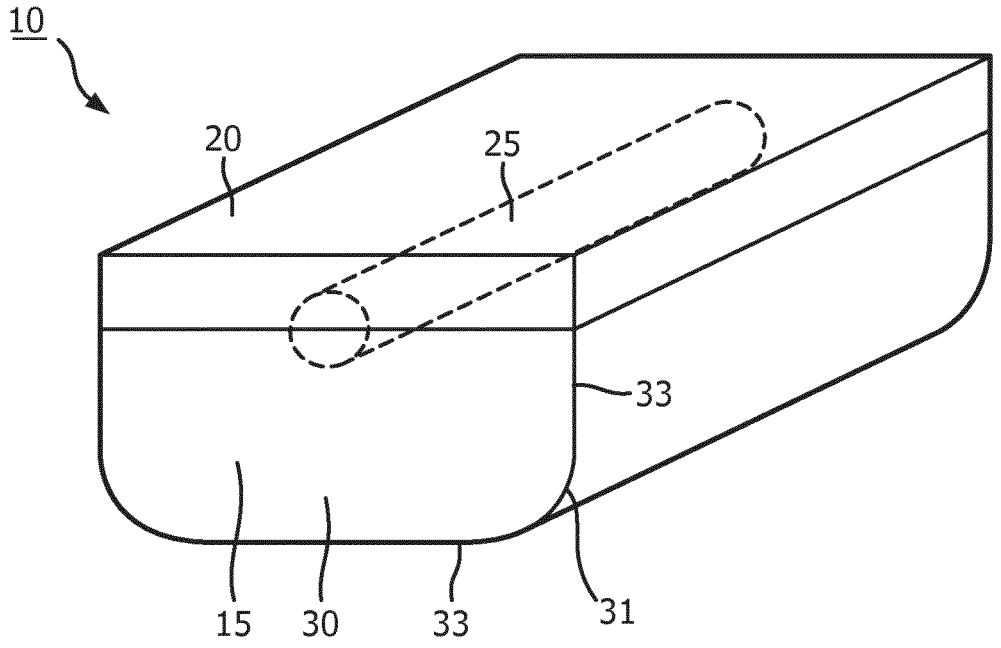
FIG. 1 (Prior art)
FIG. 1 schematically depicts a prior art luminaire.

It should be understood that the Figures are merely schematic and are not drawn to scale. It should also be understood that the same reference numerals are used throughout the Figures to indicate the same or similar parts.

Figure 2:
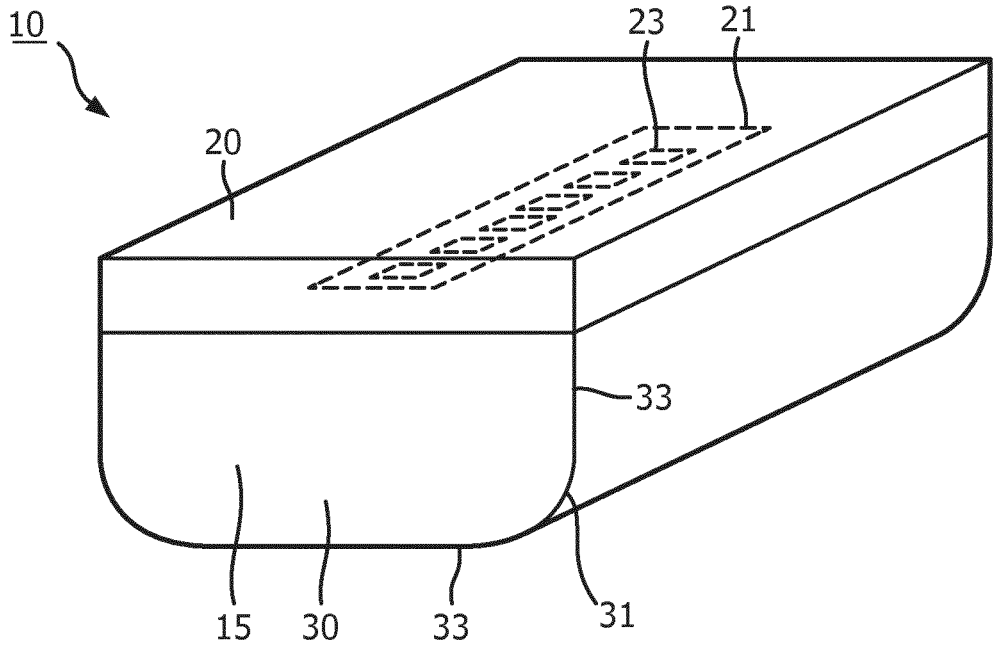
FIG. 2 schematically depicts a luminaire including solid-state lighting elements.
Figure 3:
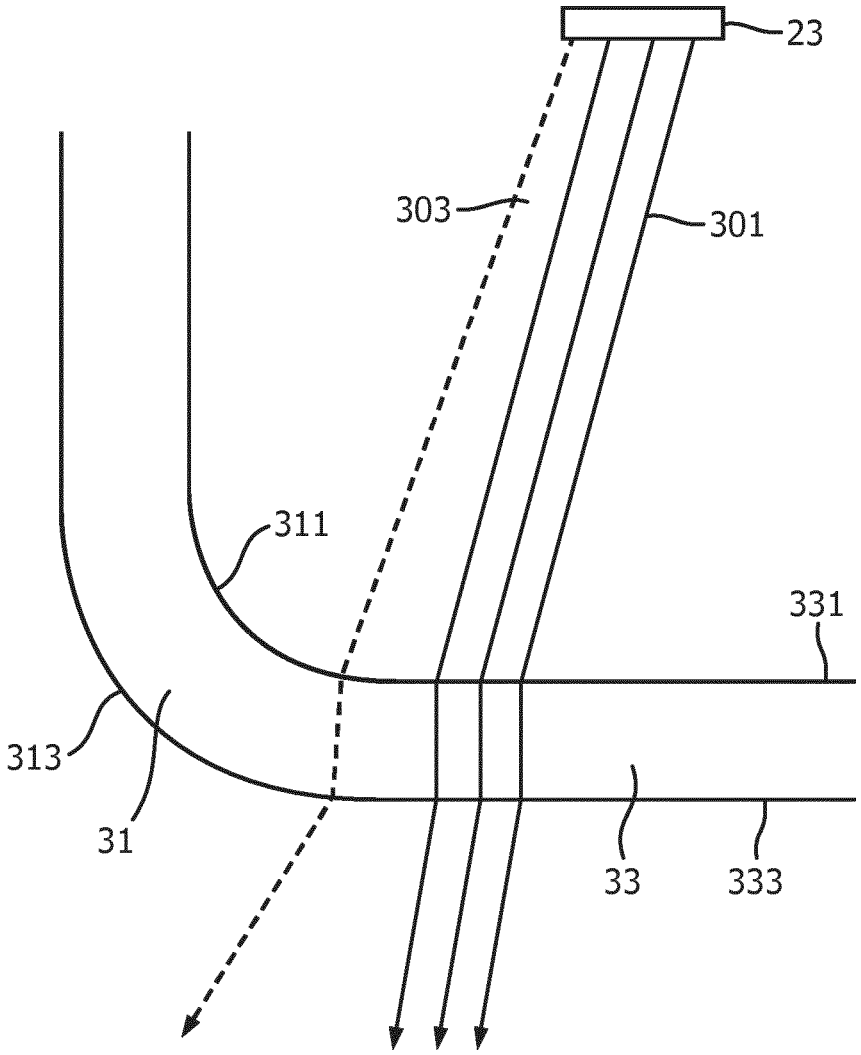
FIG. 3 schematically depicts the optical performance of the luminaire of FIG. 2 when deployed with the prior art housing.
Figure 4:
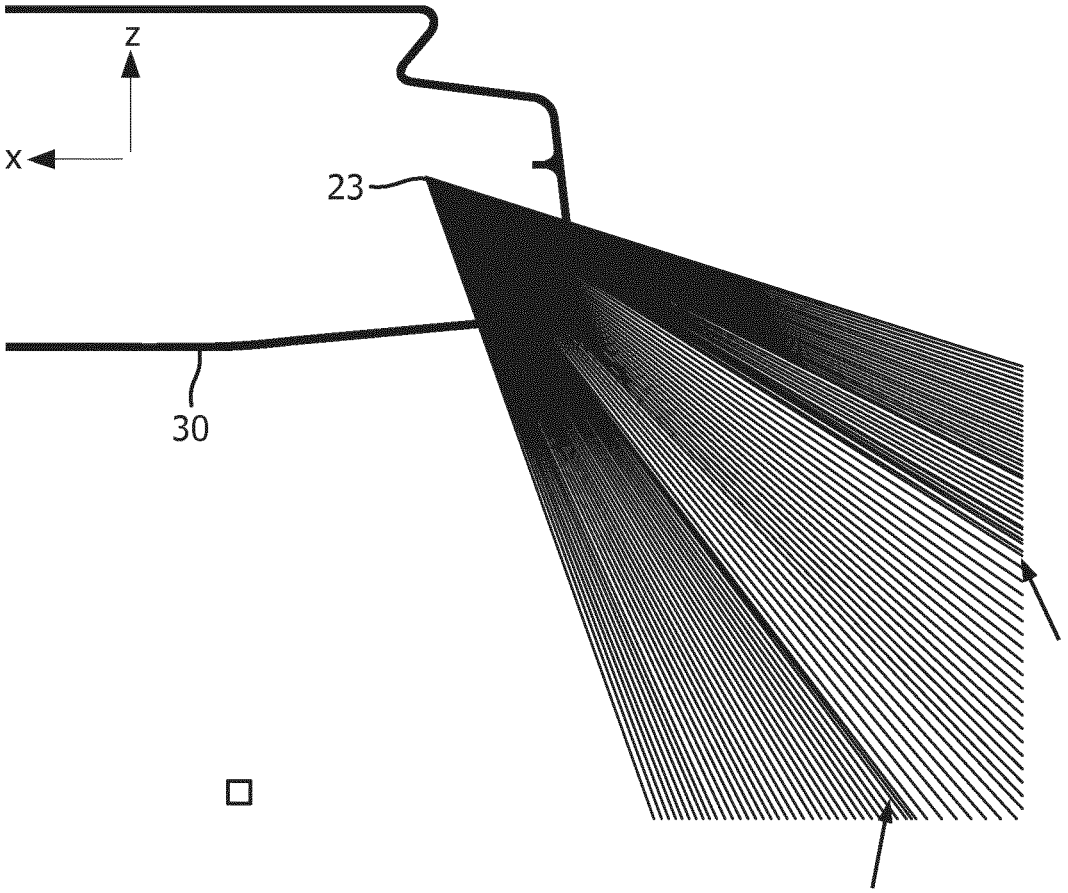
FIG. 4 is a ray trace of part of a luminaire as in FIG. 2 when deployed with the prior art housing.

FIG. 3 schematically depicts an aspect of a prior art light-transmissive cover 30 as depicted in FIG. 1 when equipped with SSL elements 23 as schematically depicted in FIG. 2. FIG. 3 highlights a root cause of the optical artefacts that may occur in such a scenario. The light-transmissive cover 30 is typically designed using CAD software in which one of the inner surface 311 and the outer surface 313 of the curved corner section 31 is drawn after which an offset function in the CAD software is used to generate the other of the inner surface 311 and the outer surface 313, thereby generating opposing curved surfaces with a different radial distance (corresponding to a constant wall thickness of the cover 31) from a central point used to define these curved (arcuate) surfaces. In other words, the difference in radius between the inner surface 311 and the outer surface 313 is equal to the offset between the inner and outer walls of the cover. In such a design, light rays 303 emitted by the SSL element 23 may enter the cover material via the inner surface 331 of a section 33, which may be a planar section in some embodiments or which may be slightly curved in some other embodiments, i.e. may be near-planar, but exit the cover 30 via the outer surface of the adjacent curved corner section 31, which causes the light rays 303 to diverge from light rays 301 that enter the cover material via the inner surface 331 of a section 33 and exit the cover 30 via the outer surface 333 of the section 33. As can be seen in FIG. 4, which depicts a simulated ray fan of such a cover arrangement (a cross-section of the cover 30 is schematically depicted), at the boundary between the further sections 33, e.g. planar sections or near-planar sections, and the rounded corner sections, bright lines in the luminous distribution generated with the SSL element 23 (here approximated by a point source) as indicated by the arrows appear in the ray fan, in which light rays are represented by black lines. It can be seen that the area between the arrows in FIG. 4 has fewer light rays, which is indicative of the aforementioned boundary-induced divergence.

The reason why such optical artefacts do not appear (to the same extent) when the luminaire housing 10 comprises an incandescent or fluorescent light source is because the light emitting area of such a light source is large relative to the distance between the light emitting area and the cover 30 such that imperfections in the shape of the tube are not visible, e.g. due to overlapping intensity peaks in case of multiple fluorescent tubes within the luminaire housing 10. However, the light emitting area of individual (square) SSL elements 23 typically is in the region of 0.2×0.2 mm to 1×1 mm, such that imperfections in the shape of the tube become visible in the luminous output of the luminaire.

This problem may be solved using larger area SSL elements, e.g. chip-on-board LEDs, but such SSL elements make it more difficult to achieve certain desired intensity distributions and are less suitable in elongated luminaires, e.g. linear luminaires, as they behave as concentrated light sources that are clearly identifiable as separate light sources when arranged in a linear array, which is undesirable, and are more difficult to thermally manage in such elongated luminaires. Alternatively, each SSL element 23 may be optically coupled to a diffuser to increase the etendue of the SSL element, thereby reducing the severity of the optical artefacts, or alternatively the light-transmissive cover 30 may be made of a diffuse material. However, with such arrangements it becomes practically impossible to create intensity distributions other than (near-) Lambertian distributions. Yet another solution would be to position the SSL elements 23 closer to the light-transmissive cover 30 (in a vertical direction in FIG. 2) to avoid (large amounts of) light passing through the curved corner sections 31, but this negatively affects the appearance of the luminaire and furthermore increases the risk of a mechanical impact between the SSL elements 23 and the cover 30, which may be incompatible with impact resistance requirements, e.g. as often is the case for waterproof luminaires. Further still, the housing 10 may be eliminated but this obviously is not a preferred solution where the luminaire is to be waterproof or where the housing 10, i.e. the light-transmissive cover 30 is to provide a physical barrier between the outside world and the SSL elements 23, e.g. to protect a person from accidental electrocution by touching the SSL elements 23.

In accordance with embodiments of the present invention, the light-transmissive cover 30 having at least one rounded corner section 31 in between two further sections 33, e.g. planar sections or near-planar sections, is designed such that opposing inner endpoints of its inner surface 311 and opposing outer endpoints of its outer surface 313 are arranged such that a ray of light emitted by any solid state lighting element 23 within the optical chamber 15 passes through both the inner endpoint and its proximal outer endpoint. In other words, any ray of light emitted by a SSL element 23 incident on a further section 33 of the cover 30 will exit the cover 30 through the same section and any ray of light emitted by a SSL element 23 incident on a curved corner section 31 of the cover 30 will exit the cover 30 through the same curved corner section.

Other than this requirement, the light-transmissive cover 31 may have any suitable shape, e.g. an elongate linear shape to define an elongate optical chamber 15 in which an elongation direction of the mounting region of the light source, e.g. a linear array 21 such as a strip of SSL elements 23, runs parallel to an elongation direction of the light-transmissive cover 30, e.g. to the elongation direction of an elongate planar section 33 and the elongation direction of an elongate curved corner section 31. For example, the luminaire comprising a luminaire housing including such a light-transmitted cover 30 may be a waterproof luminaire designed to resemble elongate luminaires for receiving fluorescent tubes although it should be understood that the teachings of the present invention may be applied to other shapes of luminaires as well. In addition, other than the requirement that the light-transmissive cover 30 includes at least one curved corner section 31 in between two further sections 33, which preferably are planar or near-planar, the light-transmissive cover 30 may have any suitable shape. By way of non-limiting example, the light-transmissive cover 30 may include further curved sections, e.g. may have a cross-section comprising a pair of opposing rounded corner sections 31 with one of the further sections 33 in between these rounded corner sections, may comprise different cross-sections at different points along an elongation direction of the light-transmissive cover 30, or may have a non-linear shape, e.g. a revolved profile.

The luminaire including such a light-transmissive cover 30 may have a luminaire housing 10 that is formed in its entirety by the light-transmissive cover 30 or by a light-transmissive cover 30 cooperating with a base 20. The luminaire may include any suitable number of SSL elements 23, e.g. one or more linear arrays 21 of SSL elements 23, as well as non-linear arrangements of such SSL elements 23. In embodiments of the present invention, such a luminaire may be a waterproof luminaire although alternative embodiments in which the luminaire is not waterproof are also contemplated.

The light-transmissive cover 30 may be made of any suitable material, such as a polymer material that is (substantially) waterproof. Non-limiting examples of suitable polymers include polycarbonate, PMMA and PET, which have the advantage that the light-transmissive cover 30 may be manufactured from such materials in a straightforward manner, e.g. by extrusion or moulding such as injection moulding.

Figure 5:
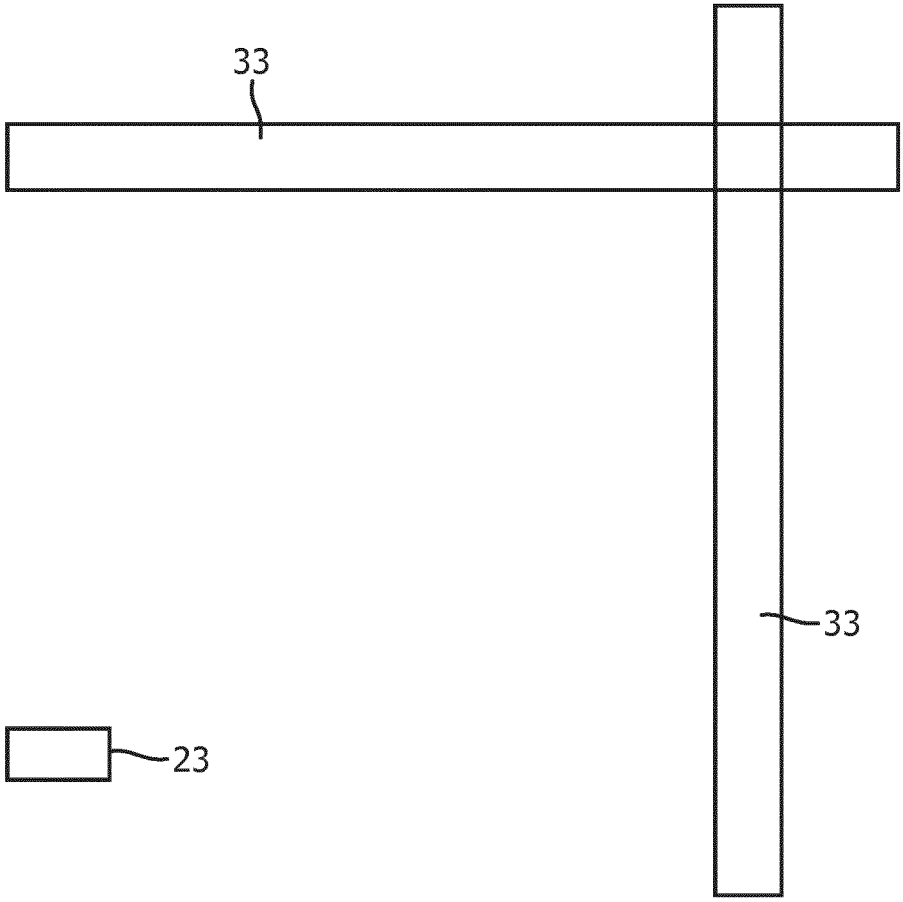
FIG. 5 schematically depicts an aspect of a design method for a luminaire housing according to an embodiment.
Figure 6:
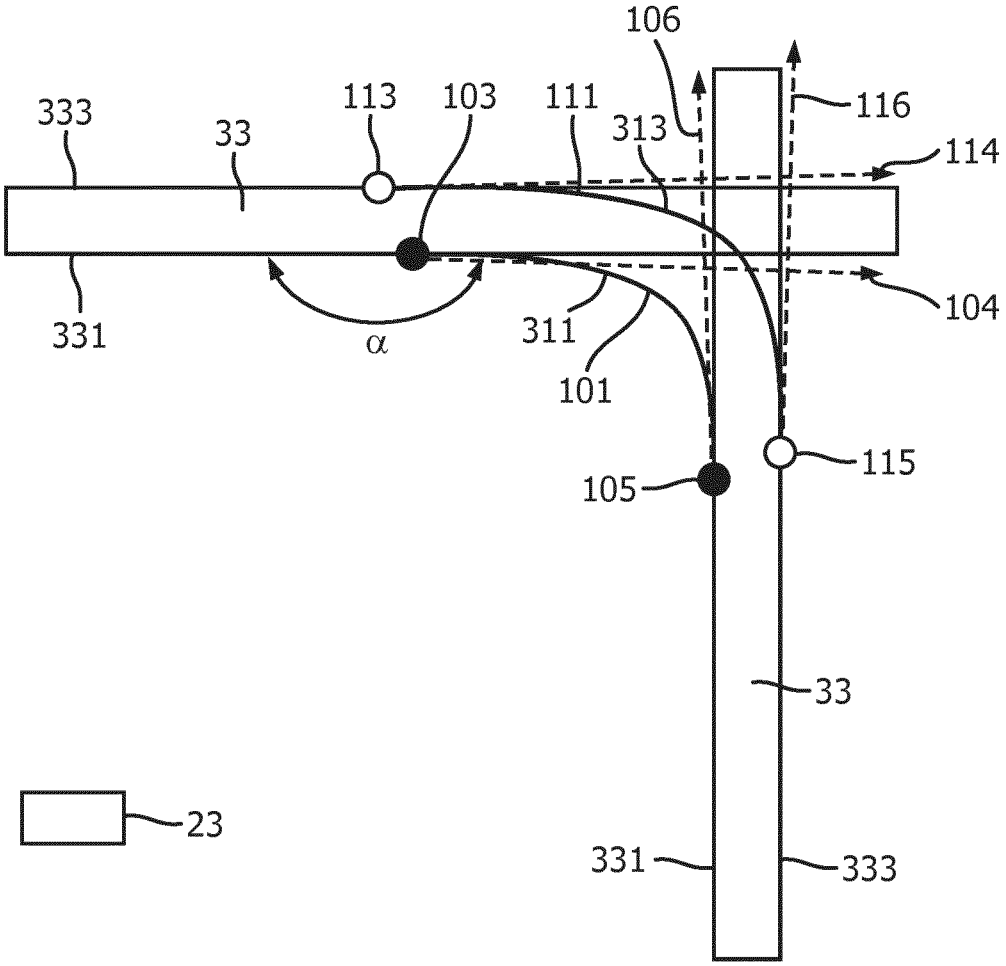
FIG. 6 schematically depicts a further aspect of a design method for a luminaire housing according to an embodiment.
Figure 7A:
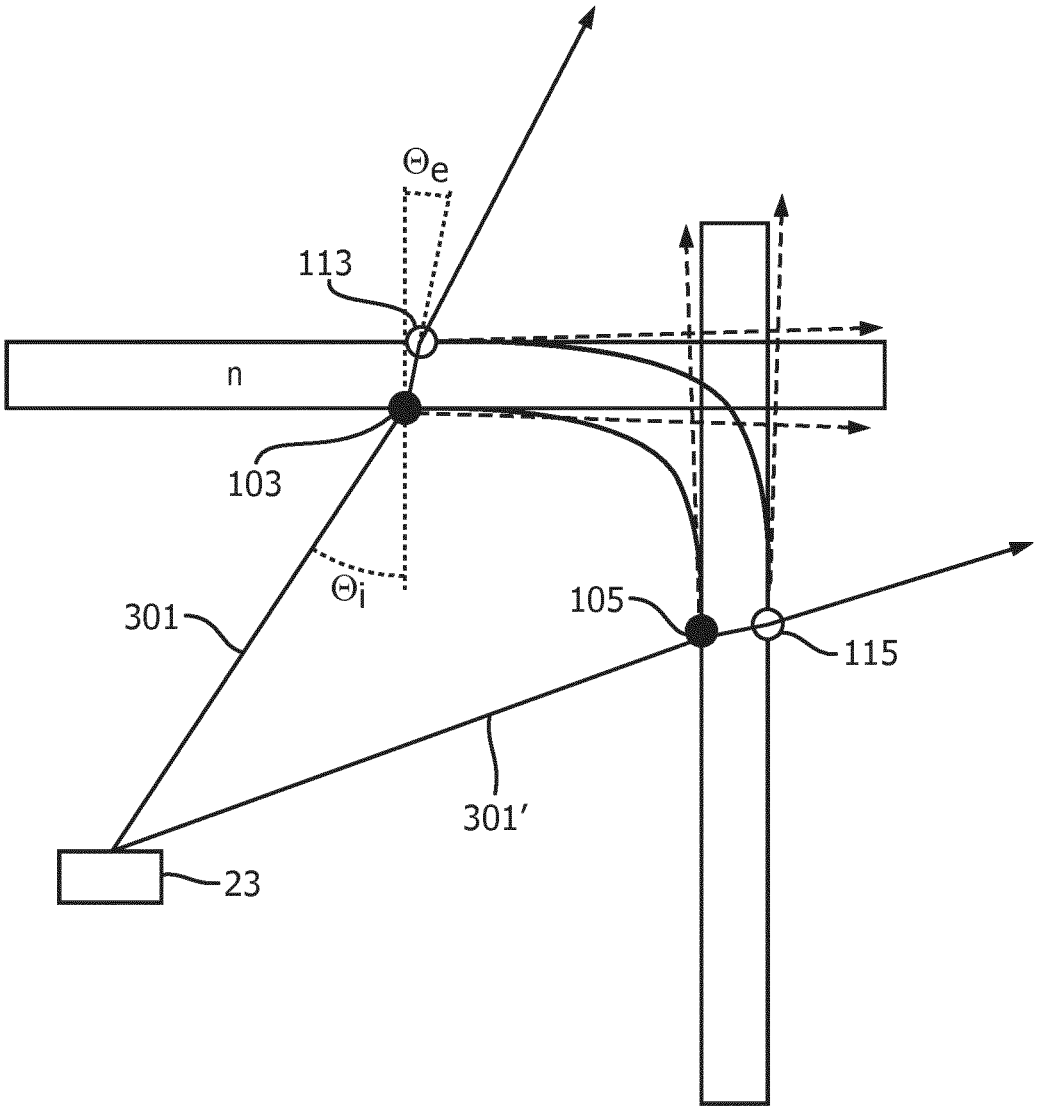
FIG. 7A-B schematically depicts yet a further aspects of a design method for a luminaire housing according to an embodiment.
Figure 7B:
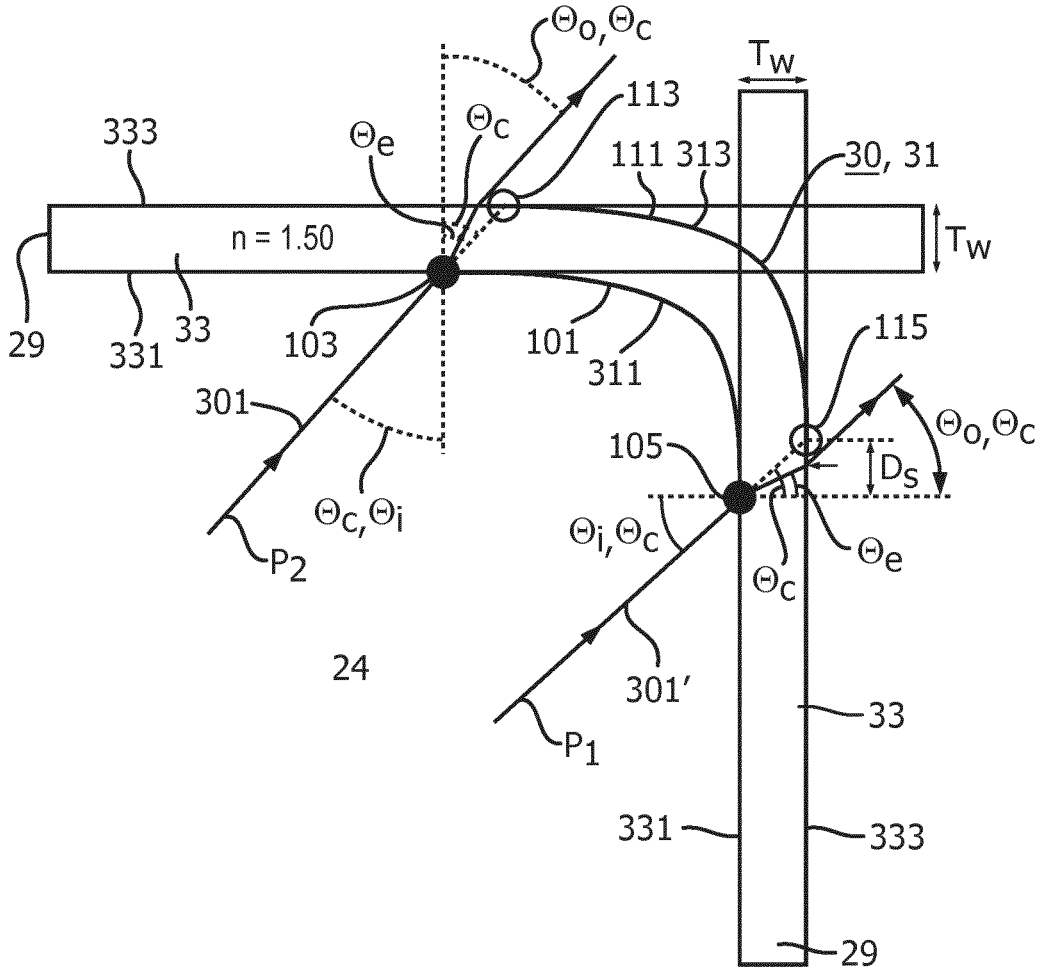
Figure 8:
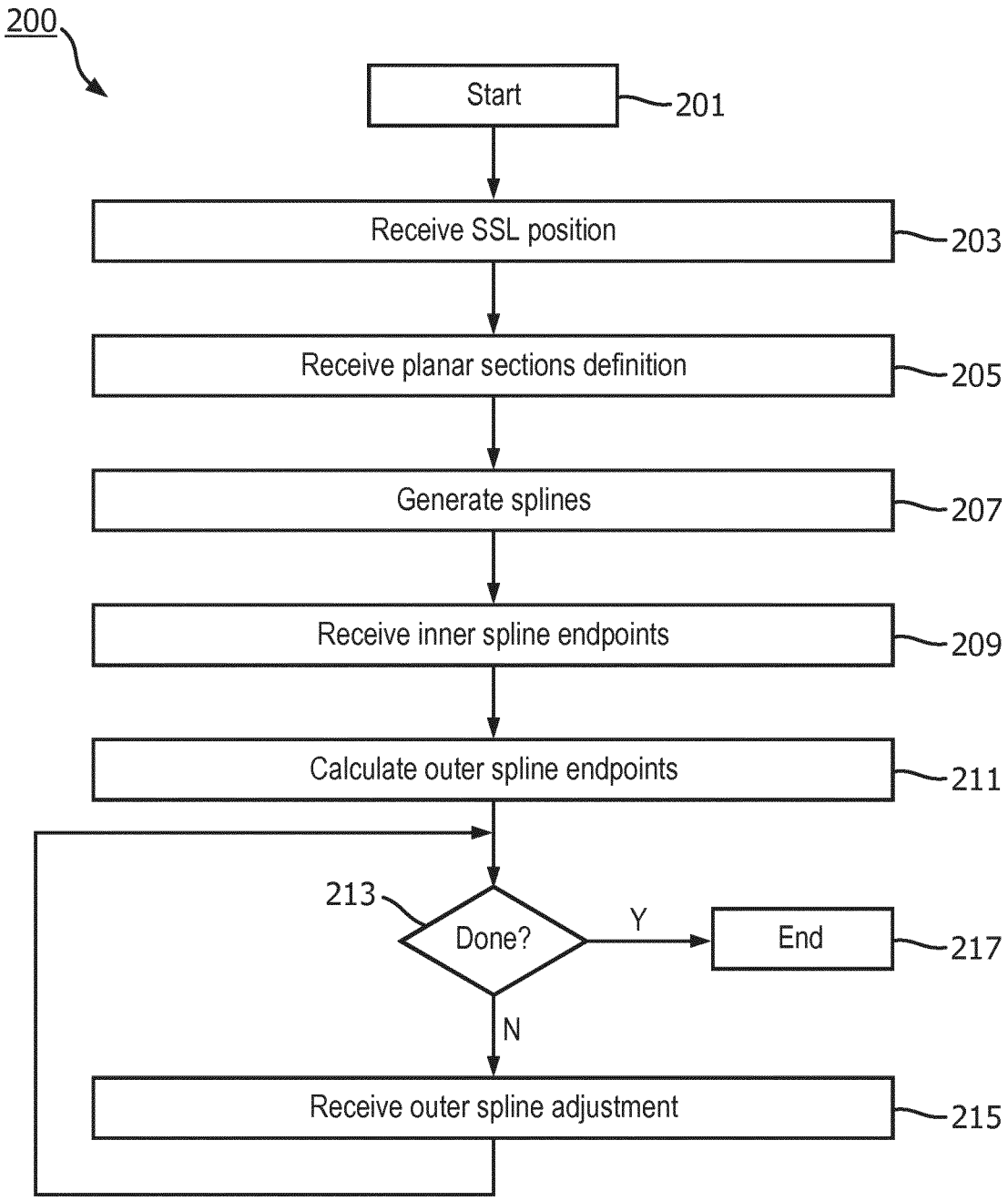
FIG. 8 is a flowchart of a design method for a luminaire housing according to an embodiment.

FIGS. 5-7 schematically depict several steps and FIG. 8 depicts a flowchart of a computer-implemented method 200 of designing such a light-transmissive cover 30 in accordance with embodiments of the present invention. These figures will now be described together in further detail.

The method 200 starts in 201, e.g. by a designer launching a computer program on a computer that implements the computer-implemented method 200, after which the method 200 proceeds to 203 in which the designer specifies the mounting position of the SSL elements 23 within the optical chamber 15 of the luminaire housing 10. The designer may provide this specification in any suitable manner, e.g. using any suitable user interface of the computer hosting the computer-implemented method 200.

Next, the designer specifies in 205 the respective orientations, thicknesses and positions of the further sections 33 of the light-transmissive cover 30, which further sections may be planar sections or near-planar sections as previously explained. The light-transmissive cover 30 is to be realized in a specified material having a defined refractive index. In the context of the present application, the refractive index of the material may be defined as the refractive index of that material at a wavelength of 550 nm. However, in alternative embodiments any refractive index of that material within the visible spectrum, e.g. from 400 nm to 700 nm, may be used. It may be assumed that variations in the refractive index of the material within the visible spectrum are small enough such that they may be ignored. The positioning of the specified SSL element 23 and further sections 33 of the light-transmissive cover 30 is schematically depicted in FIG. 5, in which the further sections 33 (here planar sections) are represented by (overlapping) rectangles having a thickness or width corresponding to the specified thickness of the further sections 33 by way of non-limiting example.

In 207, the method 200 generates a first spline 101 representing the inner surface 311 of the curved corner section 31 of the light-transmissive cover 30 as shown in FIG. 6, which first spline 101 is delimited by opposing endpoints 103 and 105 defining the boundary between the curved corner section 31 and the adjacent further sections 33. The first endpoint 103 is associated with a first vector 104 and the second endpoint 105 is associated with a second vector 106, which vectors have a length and direction corresponding to the curvature of the first spline 101. An angle $\alpha$ between each vector and the inner surface 331 of the adjacent planar section 33 should not exceed 180°, i.e. the first spline 101 preferably is arranged tangentially to its neighbouring inner surface 331 to ensure the desired boundary conditions for incident light from the SSL element 23, although in some embodiments the angle $\alpha$ may be smaller than 180°, for example to factor in the size of the SSL element 23 (which in case $\alpha$=180° is assumed to be a point source).

The designer may adjust the positions of the first endpoint 103 and the second endpoint 105 in 209 as well as the length of the vectors 104 and 106 in order to achieve the desired curvature of the inner surface 311 of the curved corner section 31 of the light-transmissive cover 30. At this point, the first spline 101 may be shaped to have any shape within the aforementioned design requirements.

Upon completion of the specification of the first spline 101 by the designer, the method 200 calculates a second spline 111 representing the outer surface 313 of the curved corner section 31 of the light-transmissive cover 30 in 211. The second spline 111 has a first outer endpoint 113 associated with a first further vector 114 and a second outer endpoint 115 associated with a second further vector 116, which further vectors have a respective length defining the curvature of the second spline 111. The first outer endpoint 113 and the second outer endpoint 115 define the boundary between the second spline 111 and the outer surface 333 of the adjacent further section 33. An angle $\beta$ (not shown) between each further vector 114, 116 and the outer surface 333 of the adjacent further section 33 should not exceed 180°, i.e. the second spline 111 preferably is arranged tangentially to these outer surfaces 333.

The position of each of the outer endpoints is calculated as a function of the position of a corresponding (proximal) inner endpoint 103, 105 using Snellius' law, as schematically depicted in FIG. 7A:

$$\sin \theta i / \sin \theta e = ni/ne$$

Figure 9:
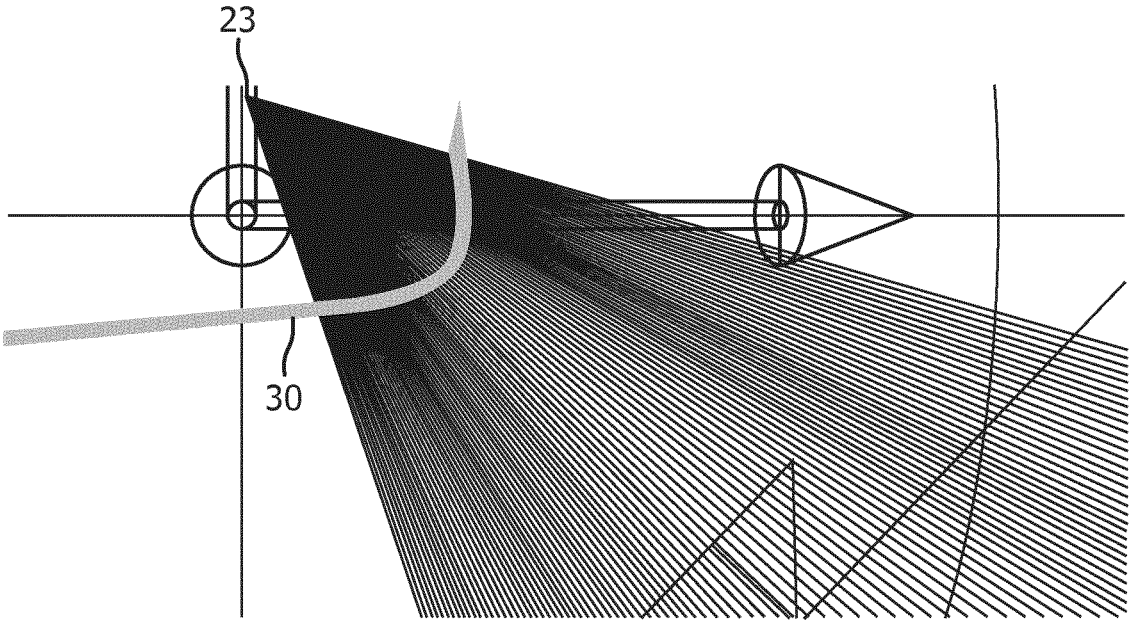
FIG. 9 is a ray trace of part of the luminaire having a luminaire housing designed in accordance with the design method according to an embodiment.

In this equation, $\theta$i is the angle of incidence of a light ray 301, 301' with an inner endpoint 103, 105 of the first spline 101 of the light-transmissive cover 30 (with respect to a defined surface normal), $\theta$e is the angle of the light ray 301, 301' (with respect to a defined surface normal) within the housing material and n is the given refraction index of the material of the housing. As will be readily understood by the skilled person, Snellius' law should be applied again to find the relationship between the angle of the light ray 301, 301' through the housing material and the exit angle of the light ray from the housing material. The respective positions where the light rays 301, 301' intersect the exit surface define the positions of the outer endpoints 113 and 115 of the second spline 111. A simulated ray fan of a resulting light-transmissive cover 30 is schematically depicted in FIG. 9, from which the disappearance of the boundary artefacts highlighted in FIG. 4 is clearly noticeable, thereby demonstrating that the imposed boundary conditions by positioning both an inner endpoint and a proximal outer endpoint of the respective splines 101 and 111 on the same ray path significantly improves the optical performance of the luminaire housing 10 including the light-transmissive cover 30.

However, further optimization of the optical performance of the luminaire housing 10, i.e. the light-transmissive cover 30, e.g. to achieve a more desirable intensity distribution produced with the luminaire, is shown in FIG. 7B. FIG. 7B shows a part of a luminaire housing 10 comprising a light chamber 15 at least partially delimited by a light-transmissive wall 29 with a constant wall thickness Tw of a cover 30 made of PolyMethylMethAcrylate (PMMA) with a refractive index of n=1.5, comprising at least one rounded corner section 31 in between two further linear, planar sections 33. Said light chamber comprising a mounting region 24 for mounting at least one solid state lighting element, wherein the rounded corner section has an inner surface 311 having opposing inner endpoints 103, 105 and an outer surface 313 having opposing outer endpoints 113, 115. At the endpoints 103,105,112,115 a tangent to the surface 311,313 of the rounded corner section 31 is parallel to a tangent to a proximal further inner surface 331,333 of its proximal further section 33, i.e. both the inner and outer surface have a smooth transision between the further, linear, planar section and the rounded corner section, in other words said transition is without a discontinuity such as a kink or step. A plane P1,P2 under critical angle $\theta$c ($\theta$c=41.8° for PMMA with n=1.50) at the inner surface 311 at an inner endpoint 103,105, and viewed in projection as shown in FIG. 7B, crossing the wall only one time, does not extend through the outer surface 313 of the rounded corner section 31. The mounting region 24 is outside an area range between the wall 29 and at least one of said planes P1,P2 alongside its proximal further section of said wall for no ray of light 301, 301' emitted by the at least one solid state lighting element entering the light-transmissive cover via the further inner surface 331 of the further section to exits the light-transmissive cover from the outer surface of the rounded corner section. Thus, a ray 301, 301' entering the cover via an inner wall of a further, linear planar section, at an angle $\theta$i, exits the cover via a further, linear, planar section of the outer wall at an angle $\theta$o, wherein $\theta$i=$\theta$o. It is furthermore shown in FIG. 7B that the wall has a thickness Tw and that the outer endpoint then is shifted over the wall towards the centre of the rounded corner relative to the inner endpoint proximal to said outer end point at least by a distance Ds=tan($\theta$c)*Tw.

However, still further optimization of the optical performance of the luminaire housing 10, i.e. the light-transmissive cover 30, e.g. to achieve a more desirable intensity distribution produced with the luminaire, may be deployed in some embodiments of the present invention. For example, the method 200 may check in 213 if after positioning of the outer endpoints 113, 115 of the second spline 111 as explained above the light-transmissive cover 30 has the desired optical performance. As will be immediately understood by the skilled person, this for example may be achieved by optical simulation. Such optical simulation tools are well-known per se and are therefore not explained in further detail for the sake of brevity only.

If it is decided in 213 that further optimization of the optical performance of the light-transmissive cover 30 is warranted, the method 200 may proceed to 215 in which the curvature of the second spline 111 may be adjusted without repositioning of its outer endpoints 113, 115, such that the boundary conditions achieved by the positioning of these outer endpoints is not affected by the adjustment of this curvature. In an embodiment, the curvature of the second spline 111 may be adjusted by the designer by altering the length of at least one of the first further vector 114 and the second further vector 116. Alternatively or additionally, the designer may adjust the curvature of the first spline 101, for example by adjusting the length of at least one of the first vector 104 and the second vector 106. In a further embodiment, the designer may reposition at least one of the outer endpoints 113, 115 away from its adjacent further section 33, such that a light ray incident on a curved inner surface 311 of the light-transmissive cover 30 may exit the cover through the outer surface 333 of a further section 33 but no light ray incident on a planar inner surface section 331 of the light-transmissive cover 30 can exit the cover through the outer surface 313 of a curved corner section 33. This may further improve the optical boundary effects by blending the transition between the curved corner section 31 and an adjacent planar section 33.

After each adjustment, the method 200 may revert back to 213 in which it is checked if the adjusted design of the curved corner section 31 of the light-transmissive cover 30 is represented by the first spline 101 and the second spline 111 has improved optical characteristics, e.g. improved convergence or divergence of light rays originating from the SSL element 23 passing through the curved corner section 31. If this is not the case, the adjustment may be rejected by the method 200 or alternatively the method 200 may provide an indication of the change in optical characteristics, e.g. a visible indication on a display device coupled to the computer on which the method 200 is executed.

On the other hand, if the adjusted design of the curved corner section 31 exhibits improved optical characteristics, it further may be checked in 213 if the adjusted design still complies with design requirements, e.g. manufacturing tolerances of the light-transmissive cover 30. In particular, as will be understood by the skilled person, the ability to individually adjust the curvature of the inner surface 311 and the outer surface 313 of such a curved corner section 31 (by adjustment of the curvature of the corresponding first spline 101 and second spline 111 respectively), may lead to a curved corner section 31 of non-constant thickness, which thickness variation may exceed design tolerances or alternatively may lead to a minimum or maximum thickness of the curved corner section 31 exceeding design tolerances. If such design tolerances are exceeded, the method 200 may reject the design alteration as previously explained after which the method 200 may return to 215. This iterative process may be repeated until it is decided in 213 that the curved corner section 31 has the desired optical performance and complies with design requirements, after which the method 200 may terminate in 217, for example with the generation of an output comprising a design specification of the thus designed light-transmissive cover 30, e.g. a CAD file or the like.

Such a design specification may be used to manufacture a mold or the like in which the light transmissive cover 30 may be formed, e.g. by extrusion or another suitable manufacturing method, e.g. (injection-)moulding. The light transmissive cover 30 may be manufactured using such a mold or the like, thereby providing at least part of a luminaire housing 10 having improved optical performance when used in conjunction with correctly positioned SSL elements 23, i.e. in a designated mounting region within the optical chamber 15, as previously explained.

At this point it is noted that the above embodiments of the design method of the light-transmissive cover 30 are explained by way of non-limiting example only and that many variations will be immediately apparent to the skilled person. For example, each spline 101, 111 may be defined by intermediate points in addition to opposing endpoints, e.g. to provide a higher order spline in which the curvature of the corresponding surface of the curved corner section 31 may be controlled in a more fine-grained manner. Similarly, the skilled person will appreciate that the inner and outer surfaces of the curved corner section 31 do not necessarily need to be represented by splines but may be represented by any suitable adjustable curved element.

Figure 10:
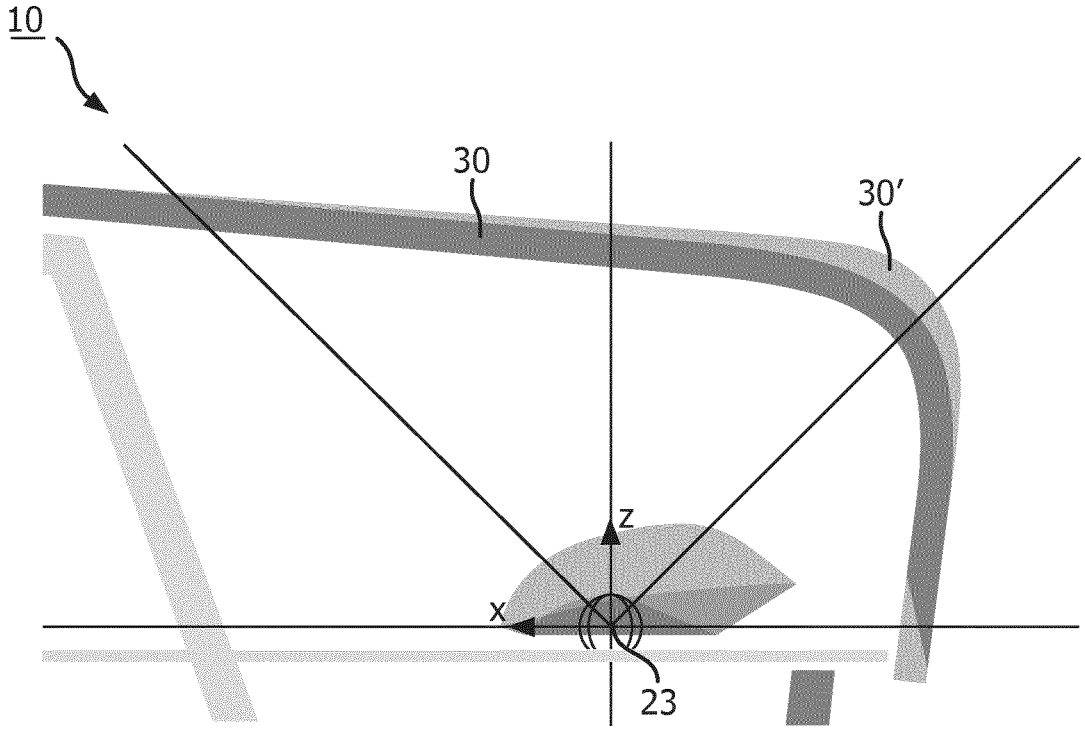
FIG. 10 schematically depicts a difference between a prior art luminaire housing and a luminaire housing designed in accordance with a design method according to an embodiment.
Figure 11:
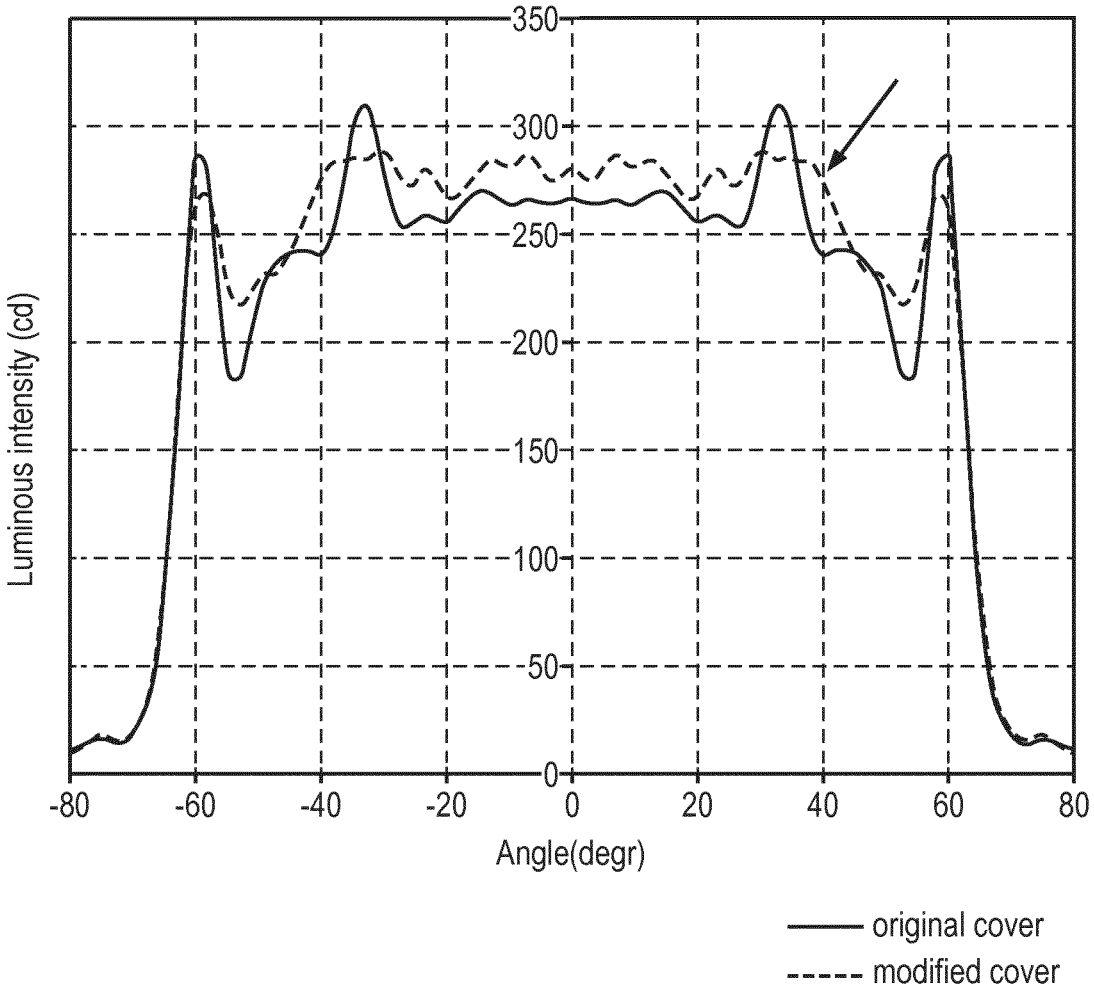
FIG. 11 is a graph depicting the difference in optical performance between the prior art luminaire housing and the luminaire housing designed in accordance with a design method according to an embodiment as shown in FIG. 10.

FIG. 10 schematically depicts an aspect including a curved corner section of a prior art light-transmissive cover 30' designed in accordance with the above described prior art design method leading to identically curved inner and outer surfaces of a curved corner section 31 and a light-transmissive cover 30 designed in accordance with an embodiment of the present invention. The optical performance of these covers is schematically depicted in FIG. 11, which depicts the intensity distribution of the prior art cover 30' and the cover 30 designed in accordance with an embodiment of the present invention as a function of an emission angle from a SSL element 23 placed within an optical chamber at least partially delimited by the prior art cover 30' and inventive cover 30 respectively. The intensity distribution of the inventive cover 30 is further highlighted by the arrow in FIG. 11. For this example, it can be clearly seen in FIG. 10 that the inventive cover 30 has a different curvature of the rounded corner section 31, whereas it is clearly noticeable in FIG. 11 that the optical performance of the inventive cover 30 has improved compared to the prior art cover 30' due to the fact that the peaks and valleys in the intensity distribution of the inventive cover 30 are less pronounced compared to the prior art cover 30'. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A computer-implemented method of designing a light-transmissive cover having a defined refractive index and comprising at least one rounded corner section in between two further sections for a luminaire housing further comprising a light chamber delimited by the light-transmissive cover, the method comprising:

receiving a defined position of a solid state light source within the light chamber;

receiving a specification of the orientation, thickness and position of each of the further sections relative to the defined position;

defining a first spline representing an inner surface of the rounded corner section, said first spline comprising a first inner endpoint connecting to an inner surface of the first further section of the two further sections and a second inner end point connecting to an Inner surface of the second further section of the two further sections;

defining a second spline representing an outer surface of the rounded corner section, said second spline comprising a first outer endpoint connecting to an outer surface of the first further section and a second outer endpoint connecting to an outer surface of the second further section by calculating the position of the first inner endpoint and the second outer endpoint such that a simulated first ray of the solid state light source passing through the first inner endpoint also passes through the first outer endpoint and a simulated second ray of the solid state light source passing through the second inner endpoint also passes through the second outer endpoint; and generating an output of a design specification of the light-transmissive cover including the defined first and second splines, wall-thickness Tw, and relative positions of inner end point and proximal outer end point.

2. The computer-implemented method of claim 1, further comprising:

calculating a ray path through the light-transmissive cover for each ray based on an angle of incidence of said ray with said inner endpoint and the defined refractive index; and positioning the corresponding outer endpoint on said ray path.

3. The computer-implemented method of claim 1, further comprising:

receiving an adjustment of a curvature of the second spline;

calculate a degree of convergence or divergence for light rays originating from the solid state light source and exiting the outer surface of the rounded corner section for said adjusted curvature; and accepting the curvature adjustment if said degree of convergence or divergence exhibits an improvement compared to light rays originating from the solid state light source at exiting the outer surface of the rounded corner section as defined by the second spline without said adjusted curvature.

4. The computer-implemented method of claim 3, further comprising:

determining a thickness across the rounded corner section including the adjustment to the curvature of the second spline; and rejecting said curvature adjustment if said thickness exceeds a design tolerance.

5. The computer-implemented method of claim 3, wherein:

the curvature of the first spline is defined by a first vector associated with the first inner endpoint and a second vector associated with the second inner endpoint;

the curvature of the second spline is defined by a first further vector associated with the first outer endpoint and a second further vector associated with the second outer endpoint; and receiving an adjustment of a curvature of the second spline comprises receiving a change in length at least one of the first further vector and second further vector.

6. The computer-implemented method of claim 1, wherein each spline is tangential to the further section it connects to.

7. A light-transmissive cover for a luminaire housing designed by the method of claim 1.

8. A method of manufacturing a light-transmissive cover for a luminaire housing, the cover having a defined refractive index and comprising at least one rounded corner section in between two further sections, the method comprising:

manufacturing a mold for the light-transmissive cover using the design specification including generating an output of a design specification of the light-transmissive cover including wall-thickness Tw, and relative positions of inner end points and proximal outer end points, and the defined first and second splines as produced by the computer-implemented method of claim 1; and manufacturing the light-transmissive cover with said mold.

9. A light-transmissive cover for a luminaire housing manufactured by the method of claim 8.

* * * * *